United States Patent [19]

Kondou et al.

[11] Patent Number: 4,754,162

[45] Date of Patent: Jun. 28, 1988

[54] TIMER CONTROLLED MULTIPOLE CIRCUIT BREAKER

[75] Inventors: Hideya Kondou, Hirakata; Youichi Yokoyama, Itami, both of Japan

[73] Assignee: Matsushita Electric Works, Ltd., Osaka, Japan

[21] Appl. No.: 927,977

[22] Filed: Nov. 7, 1986

[30] Foreign Application Priority Data

Nov. 25, 1985 [JP] Japan ..... 60-264407
Nov. 25, 1985 [JP] Japan ..... 60-264408
Nov. 25, 1985 [JP] Japan ..... 60-264409

[51] Int. Cl.[4] ..... H01H 3/28

[52] U.S. Cl. ..... 307/112; 307/115; 307/131; 307/141; 361/96; 361/97; 355/8; 355/10

[58] Field of Search ..... 307/112, 132 E, 141, 307/141.4, 115; 335/6, 28, 7, 8, 9, 10, 27, 46, 53, 65, 67, 87, 139, 160, 172; 361/73, 75, 83, 72, 39, 92, 195, 196, 97, 203, 90, 91, 96; 200/38 R, 38 B, 38 DA, 35 R; 337/72, 73

[56] References Cited

U.S. PATENT DOCUMENTS

| | | | |
|---|---|---|---|
| 3,656,026 | 4/1972 | Zocholl | 361/97 |
| 4,019,166 | 4/1977 | Lawrence et al. | 335/8 X |
| 4,077,024 | 2/1978 | Lisnay | 335/10 X |
| 4,272,687 | 6/1981 | Borkan | 307/115 |
| 4,342,974 | 8/1982 | Nakano et al. | 335/10 |
| 4,382,240 | 5/1983 | Kondo et al. | 335/10 X |
| 4,420,789 | 12/1983 | Breen | 361/96 X |
| 4,438,476 | 3/1984 | Breen | 361/96 |
| 4,442,472 | 4/1984 | Pang et al. | 361/96 |
| 4,454,556 | 6/1984 | DePuy | 361/73 |
| 4,476,511 | 10/1984 | Saletta et al. | 361/97 X |
| 4,538,197 | 8/1985 | Breen | 361/75 X |
| 4,570,216 | 2/1986 | Chan | 307/141.4 X |
| 4,642,726 | 2/1987 | Matsko et al. | 307/141 X |

*Primary Examiner*—William M. Shoop, Jr.
*Assistant Examiner*—Paul Ip
*Attorney, Agent, or Firm*—Armstrong, Nikaido, Marmelstein & Kubovcik

[57] ABSTRACT

A timer controlled multipole circuit breaker has a pair of breaker contacts in each pole which are connected to load and line terminals respectively provided in the current path of each pole. Incorporated in the breaker is electric timer for controlling to open and close the breaker contacts according to a predetermined timing schedule. The electric timer has its input end connected across the line terminals of the adjacent poles so as to be energized by the common power on the line terminals of the breaker without requiring any additional external wiring. The circuit breaker incorporating the electric timer of the present invention further provides a safeguard which inhibits the automatic reclosing of the contacts by the timer operation until the fault current condition is cleared.

18 Claims, 15 Drawing Sheets

TIMER CONTROLLED MULTIPOLE CIRCUIT BREAKER

BACKGROUND OF THE INVENTION

1. Field of the Invention

The present invention is directed to a timer controlled multipole circuit breaker, more particularly to such a circuit breaker having a pair of breaker contacts in each pole which is controlled by an incorporated electric timer to be closed and opened according to a predetermined timing schedule.

2. Description of the Prior Art

Due to the recent concern for energy conservation, load management system is being called for utilizing the off-peak time or night electricity power of reduced fee afforded by utilities. To this end, circuit breakers are desired to include a timer for controlling to turn on the load at the onset of the reduced fee power band and reopen the same at the expiration thereof. A circuit breaker available for this purpose is shown in U.S. Pat. No. 4,272,687 to incorporate an electric timer. The circuit breaker of this patent is designed for a single pole application and consequently the incorporated electric timer should have at least one external lead wired to the power supply outside of the breaker housing even when the timer is powered by the common power on the line terminal of the circuit breaker. Such wiring of the external lead of the timer outside of the breaker housing is inconvenient and rather difficult at the installation site, particularly when the breaker is required to be closely mounted in a limited space.

SUMMARY OF THE INVENTION

The present invention eliminates the above problem and provides a useful circuit breaker incorporating an electric timer for controlling the closing and opening of the breaker contacts according to a predetermined timing schedule. The timer controlled circuit breaker of the present invention is of multipole configuration and comprises a pair of breaker contacts in each pole which are connected to load and line terminals respectively provided in the current path of each pole. Conventional mechanisms may be included for manual operation to simultaneously open and close the breaker contacts of all poles as well as for tripping to interrupt the same upon occurrence of a fault current condition in any one of the poles. A timer controllable contact driver means is included in the breaker for closing the breaker contacts as well as for opening the contacts independently of the trip means. Also included in the breaker is electric timer means for controlling the driver means in such a way as to close the breaker contacts at a first predetermined time and reopen the contacts at a second predetermined time. The electric timer has a pair of input ends connected across the line terminals of a pair of the adjacent poles so as to be energized by the utility power on the common line terminals of the breaker. With this arrangement, the electric timer can be powered by utilization of the power on the line terminals of the breaker without requiring any additional and complicated external wiring therefor, enabling the timer to be provided in a fully incorporated configuration within a unitary breaker enclosure. This configuration is advantageous in that any existing multipole circuit breaker can be replaced by the timer controlled breaker of the present invention simply by changing the connection to the line and load terminals of the breakers and not requiring the wiring of the electric timer itself.

Accordingly, it is a primary object of the present invention to provide a timer controlled multipole circuit breaker in which the timer can be energized by the common power on the line terminals of the breaker without requiring any additional wiring and can be fully incorporated within the breaker enclosure to assure easy replacement for the existing breaker.

Another important feature contemplated by the present invention is to inhibit the automatic resetting of the breaker contacts under the control of the timer once the breaker contacts is interrupted or tripped to an open condition in response to the fault current condition and to allow the resetting by the timer only after the contacts are manually reset. Without this inhibiting scheme, the timer would automatically reset the breaker contacts in the timing cycle subsequent to the timing cycle during which the breaker contacts were interrupted upon the fault current condition. This is very dangerous when the fault current condition remains uncleared in that the load will be again exposed to the still existing fault current condition. It is therefore essential for the breaker incorporating the timer to include such inhibition means for providing the safeguard against the above possible hazard, which is another object of the present invention.

In one embodiment of the present invention, the above inhibition scheme is realized by operatively linking the contact driver means to the trip means in such a way as to inhibit the driver means from closing the breaker contacts so long as the manual contact operating means is tripped to its OFF position. Thus, the timer can be made to automatically close the breaker contacts only after clearing the fault current condition followed by manually returning the trip means to its untripped condition.

It is therefore a further object of the present invention to provide a timer controlled multipole circuit breaker in which the contact driver means is inhibited from being actuated to automatically reclose the breaker contacts by the timer until the trip mechanism is returned to its untripped position as a result of clearing the fault current condition.

The contact driver means is preferably a bistable electromagnet with an armature which is linked to the manual contact operating mechanism for stably holding the same at either operating position. Normally-closed switch means is inserted in series with an excitation coil of the electromagnet between the line terminals of the adjacent poles and is arranged to be disconnected in response to the tripping operation of the trip means. Consequently, the electromagnet or contact driver means is rendered inoperative until the trip means is returned to its untripped position.

The like inhibiting scheme is successfully realized in another embodiment of the present invention which discloses a unique contact arrangement. The manual contact operating means in each pole has a movable contact arm which carries one of the breaker contacts engageable with the other breaker contact. The other breaker contact of at least one pole is characterized to be movable between an operative position where it is engageable with the contact on the movable arm and an inoperative position where it is prevented from engaging the contact on the movable arm irrespective of the positions of the manual contact operating means. The other breaker contact rendered movable is actuated by the contact driver means for movement between the operative and inoperative positions whereby it is inhibited from being engaged with the contact on the movable contact arm so long as the movable contact arm is tripped to its OFF position. With this provision of the other breaker contact being movable to its inoperative position by the driver means, the above inhibition scheme can be obtained without the necessity of operatively linking the driver means to the movable arm, or without adding complexity to the manual contact operating mechanism including the movable arm.

It is therefore a still further object of the present invention to provide a timer controlled multipole circuit breaker in which the undesirable automatic reclosing of the breaker contacts by the timer can be effectively prevented by a simple construction.

In this embodiment, the contact driver means is preferably a monostable polarized electromagnet with an armature connected to the other breaker contact engageable with the contact on the movable contact arm such that it normally closes the breaker contacts and open the same upon selective energization thereof.

The present invention discloses more other useful and advantageous features such as the timer being provided with a time display, a time variable input section accessible outside of the breaker enclosure, shield means covering the variable input section together with the load and line terminals, and a selector knob on the breaker enclosure for selecting different on and off timing cycles predetermined by the timer.

These and still other objects and advantages of the present invention will be more apparent from the following description of the preferred embodiments when taken in conjunction with the accompanying drawings.

DETAILED DESCRIPTION OF THE PREFERRED EMBODIMENTS

Figure 1:
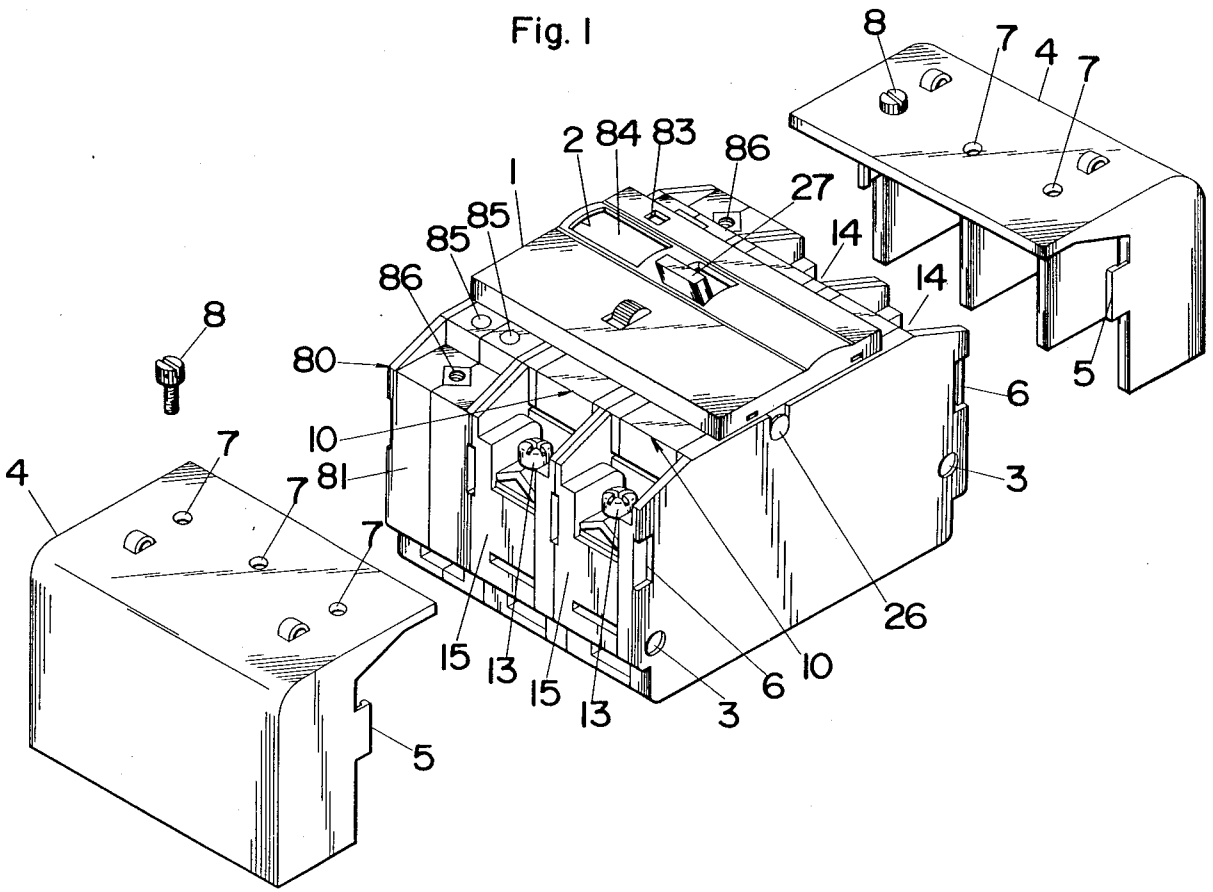
FIG. 1 is a perspective view of a timer controlled multipole circuit breaker in accordance with a first preferred embodiment of the present invention.
Figure 2:
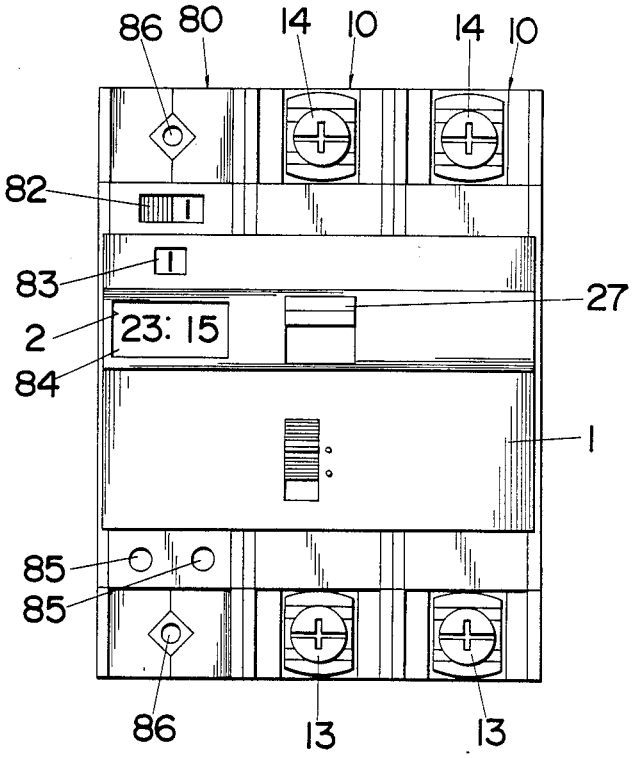
FIG. 2 is a top view of the circuit breaker.

First embodiment <FIG. 1 through FIG. 10>

Referring now to the drawings, there is shown a timer controlled multipole circuit breaker in accordance with the first preferred embodiment of the present invention. The circuit breaker is of two pole arrangement and composed of three substantially identically dimensioned units, two for pole units 10 and the rest for a timer unit 80, which units are stacked in a side-by-side relation and secured by means of a top cover 1 and lock pins 3 to present a unitary breaker enclosure. A pair of shields 4 are removably attached to the opposite terminal ends of the breaker enclosure.

Each pole unit 10 of identical construction comprises a single set of breaker contacts 11 and 12 which are connected to a load terminal 13 and a line terminal 14 on the opposite end of a casing 15. Mounted within the casing 15 of each pole unit 10 are conventional mechanisms for manually operating the breaker contacts 11 and 12, and for tripping the contacts upon occurrence of a fault current condition.

Figure 3:
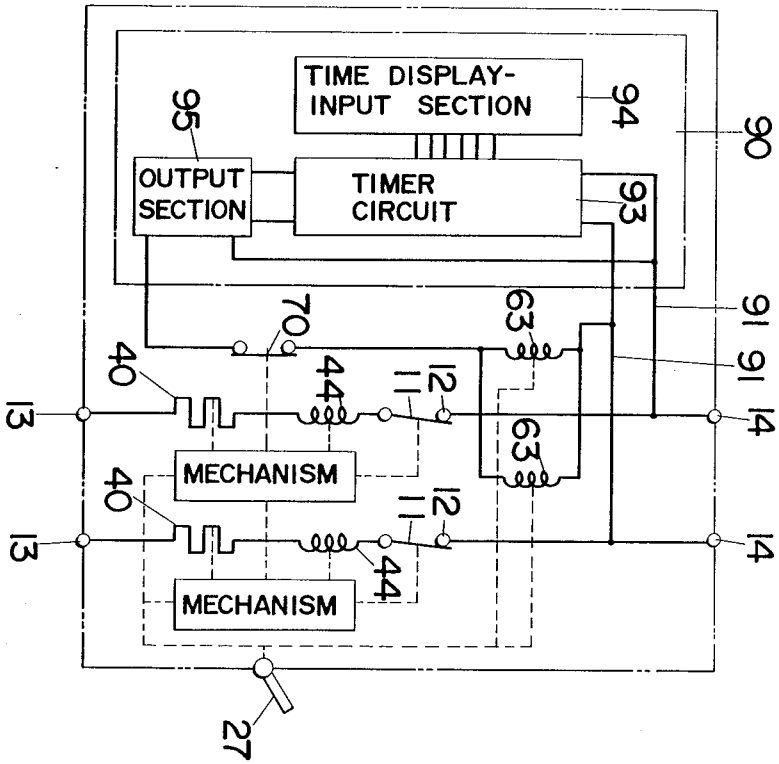
FIG. 3 is a circuit diagram of the breaker.
Figure 4:
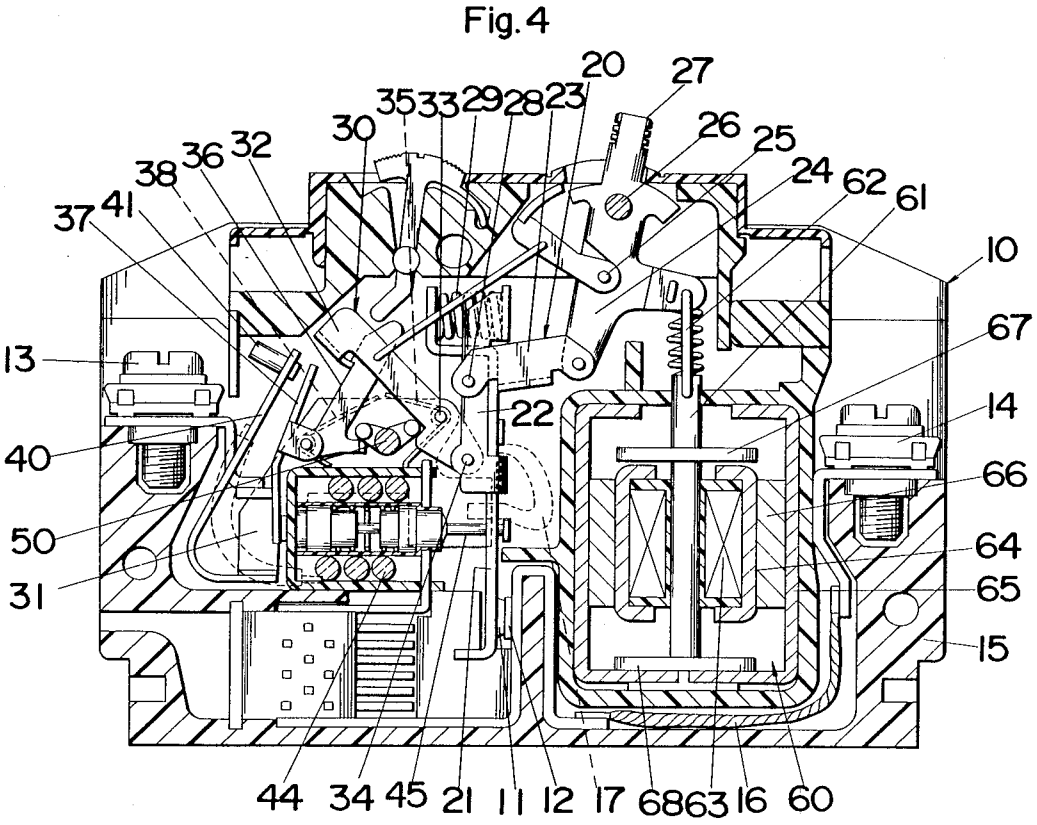
FIG. 4 is a sectional view of the breaker in one pole unit of the breaker in its ON position.
Figure 5:
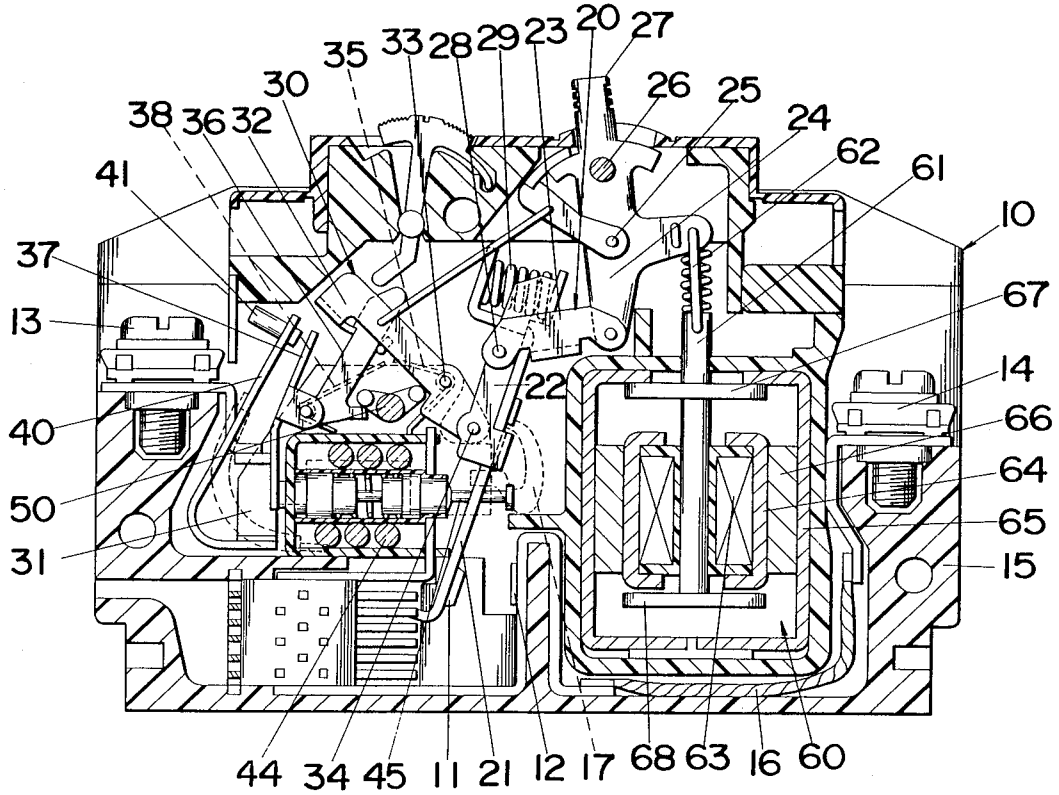
FIG. 5 is a sectional view of one pole unit of the breaker in its OFF position.

The timer unit 80 has within a casing 81 an electric timer 90 which controls to close and open the breaker contacts 11 and 12 according to a predetermined timing schedule. The electric timer 90 has its input ends connected through lines 91 across the line terminals 14 of the adjacent pole units 10, as shown in FIG. 3, in order to be energized by the common utility power on the line terminals 14. Such connection or wiring between the electric timer 90 and the line terminals 14 are made through the casings of the timer and pole units 80 and 10 so as not to appear on the exterior of the breaker enclosure. The electric timer 90, which is received in a mold 92 for mounting in the timer unit 80 (FIG. 8), is functionally composed of a timer circuit 93, a time display-input section 94 and an output section 95, as shown in FIG. 3.

The timer circuit 93 operates on an interval timing principle to produce to the output section 95 an ON signal for contact closing at the start of a predetermined timing cycle and produce an OFF signal at the end of the timing cycle for contact reopening. Two different timing cycles on 24-hour scale are originally stored in the timer circuit 93 to match with different load managing requirements. For example, there are provided a first timing cycle having ON period of 23:00 to 7:00 and a second timing cycle having ON period of 1:00 to 6:00 which are intended to be within a night electricity power band of reduced fee afforded by the utility. The selection between these predetermined timing cycles is made by a selector 82 slidably mounted on the top of the timer unit 80. Indication of the particular timing cycle being selected appears on the selector 82 itself and through a window 83 in the top cover 1.

The time display-input section 94 of FIG. 3 includes a digital display 84 for indication of the current time and a pair of time variable input buttons 85 for inputting the current time for recognition by the timer circuit 93. The digital display 84 is formed on the top of the timer unit 80 and is viewed through an opening 2 in the top cover 1 of the breaker enclosure. The input buttons 85 are formed on the top of the timer unit 80 at its end portion not to be covered by the top cover 1. Formed in the top of the timer unit 80 at its opposite ends are threaded holes 86 each being aligned with each of the load and line terminals 13 and 14 of the adjacent pole units 10. The selector 82 and the input button 85 are protected from accidental access by the shields 4 which are removably attached to the breaker enclosure with their side hooks 5 engaged with notches 6 in the corresponding timer and pole units 80 and 10. Each of the shields 4 is formed with a series of aligned apertures 7 through one of which a screw 8 extends into engagement with the threaded hole 86 for securing the shield 4 to the breaker enclosure. The two other apertures 7 are utilized for insertion of test pins to the load and line terminals 13 and 14 of the pole units 10 which are also covered by the respective shields 4.

Referring to FIGS. 4 to 7, each pole unit 10 comprises a manual contact operating mechanism 20 including a movable contact arm 21 which carries one of the breaker contact 11 engageable with the other contact 12 fixed to the bottom of the casing 15 and electrically connected through a braid 16 to the line terminal 14. The movable contact arm 21 is electrically connected to the load terminal 13 through a braid 17, a frame 31, a bimetallic strip 40, a current sensing coil 44, the last two members being supported on the frame 31. The movable contact arm 21 is held by a contact frame 22 to be movable therewith and is articulated through the frame 22 and a link 23 to an operator lever 24 so as to be actuated thereby between an ON position of closing the contacts and an OFF position of opening the contacts. The operator lever 24 is pivoted to a fixed pin 25 to be rotatable about the axis thereof. The operator levers 24 of the adjacent pole units 10 are interlocked by a connection pin 26 extending in parallel relation to the pivot axis of the operator levers 24 for simultaneous actuation of the manual contact operating mechanism 20 of the adjacent pole units 10. One of the operator levers 24 of the adjacent pole units 10 is formed with an integral handle 27 which extends outwardly of the breaker enclosure through the top cover 1 for manual operation. The movable contact arm 21 is pivotally supported by a pin 28 to the contact frame 22 at the end opposite to the breaker contact 11 and is biased by a spring 29 interposed between the same ends thereof for providing an optimum contact pressure in the contact closing condition, yet assuring the movable contact arm 21 to be movable with the contact frame 22 during the contact closing and opening operations.

Figure 6:
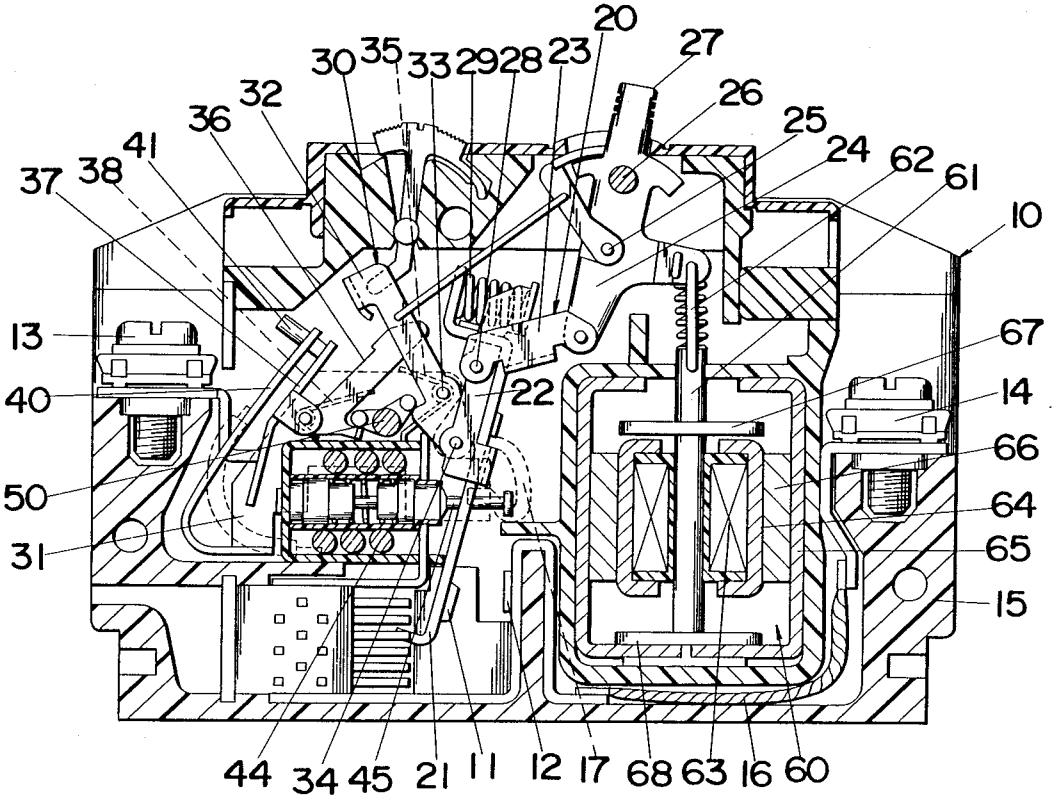
FIG. 6 is a sectional view of the pole unit of the breaker in its tripped position as a result of over-load current condition.
Figure 7:
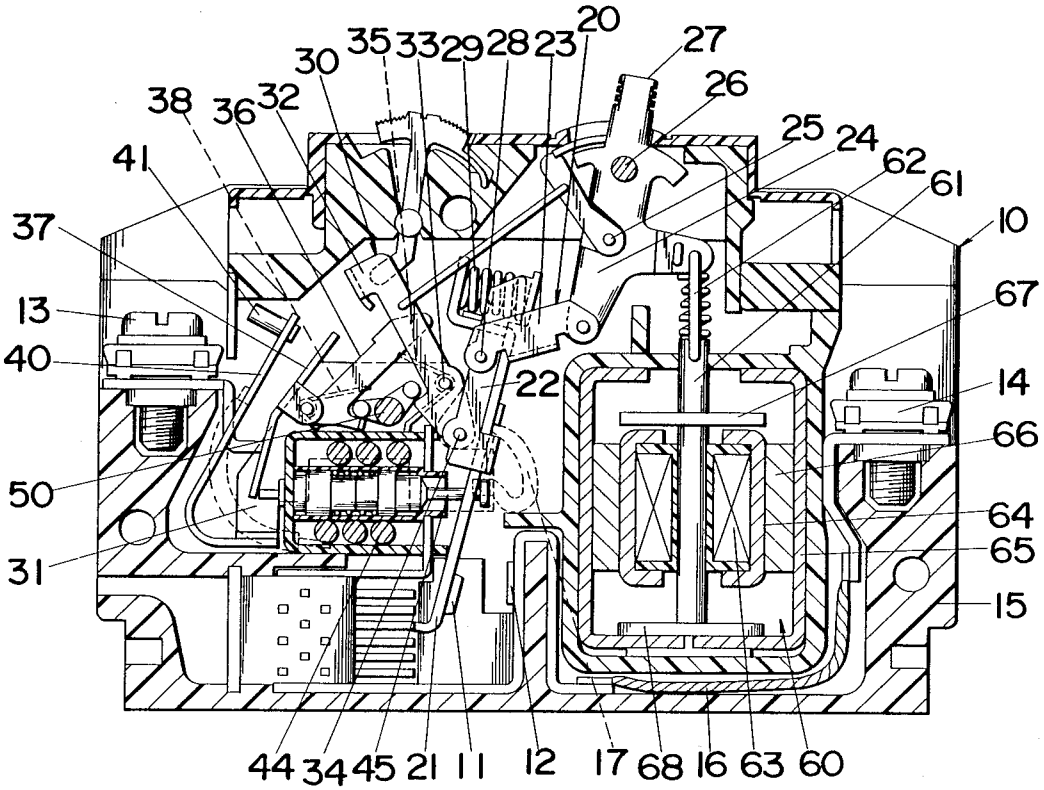
FIG. 7 is a sectional view of the pole unit of the breaker in its tripped position as a result of short-circuit current condition.

A trip mechanism 30 is also enclosed in each pole unit 10 for tripping the manual contact operating mechanism to open the contacts upon occurrence of fault current condition. The trip mechanism comprises a latch arm 32 which is pivotally supported by a pivot pin 33 to the frame 31 and which has its one end pivoted by a pin 34 to the contact frame 22 so as to be operatively articulated to the movable contact arm 21 at a portion intermediate its length. The other end of the latch arm 32 is engageable with one end of a trip lever 36 so as to be locked into a latched position of FIG. 4 against the bias of a spring 35 placed around the pivot pin 33. The latch arm 32 in this latched position holds the movable contact arm 21 in a position where it is rotatable about the axis of the pin 34 to move between the ON position of FIG. 4 and OFF position of FIG. 5 by the manipulation of the operator lever 24. When the latch arm 32 is disengaged from the trip lever 36, it rapidly rotates clockwise about the pivot axis 33 by the bias of the spring 35 to pull the movable contact arm 21 together with the contact frame 22 away from the fixed contact 12 as moving the the pin 34 toward the frame 31 for interruption of the circuit, as shown in FIGS. 6 and 7.

The trip lever 36 pivoted to the frame 31 has an integral flap 37 which extend in engageable relation with the bimetallic strip 40. When the bimetallic strip 40 flexes in response to overload current condition, as shown in FIG. 6, the trip lever 36 is pushed by a tip 41 at end of the bimetallic strip 40 to rotate in the clockwise direction against the bias of a spring 38, disengaging the latch arm 32 to trip the movable contact arm 21 away from the fixed contact 12 as in the manner described above.

The coil 44 which is inserted in the current path serves to sense short-circuit current and is associated with a plunger 45 which is movable within the coil 44 in the axial direction thereof. The plunger 45 has its ends engageable respectively with the movable contact arm 21 and the integral flap 37 of the trip lever 36 such that, when the plunger 45 is magnetically driven axially upon occurrence of the short-circuit condition, it rapidly pulls at its one end the movable contact arm 21 away from the fixed contact 12 and simultaneously pushes at the other end the trip lever 36 to disengage the latch arm 32 for tripping, thus effecting rapid and reliable interruption of the circuit.

Figure 9:
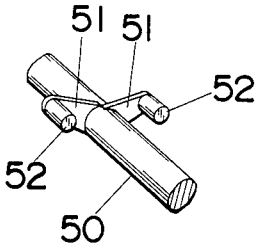
FIG. 9 is a perspective view of an interlocking rod between the stacked pole units of the breaker.
Figure 10:
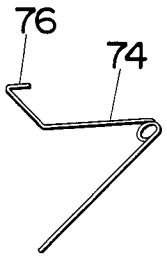
FIG. 10 is a perspective view of a joint lever extending between the timer unit and the adjacent pole unit.
Figure 11:
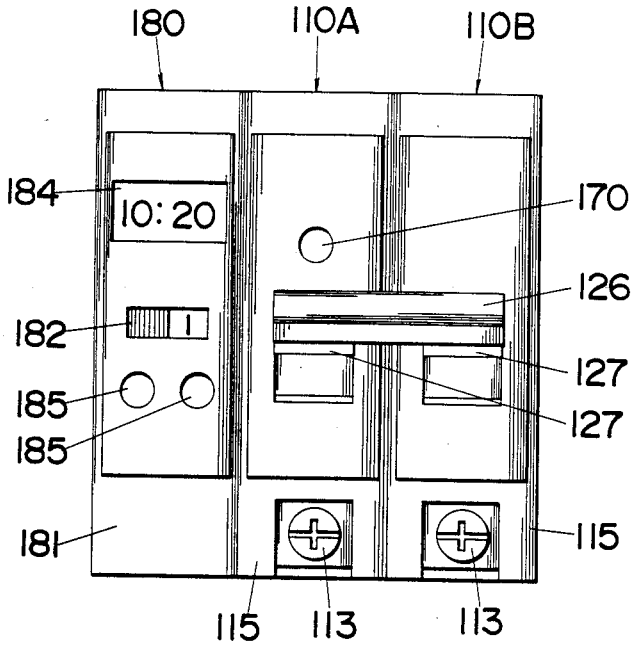
FIG. 11 is a top view of a timer controlled circuit breaker in accordance with a second preferred embodiment of the present invention.

The above tripping mechanisms in the adjacent pole units 10 are interlocked by an interlocking rod 50 for simultaneously interrupting the circuit of the all pole units 10 upon occurrence of fault current condition in any one of the poles. The interlocking rod 50 extends over the adjacent pole units 10 and is supported to be rotatable about its own axis. Formed on the rod 50 are two pairs of radial extensions 51 with a finger 52, as best shown in FIG. 9. Each pair of the extensions 51 is positioned within each pole unit 10 so that the fingers 52 of each pair of extensions 51 are in engagement respectively with the root portions of the latch arm 32 and the trip lever 36. When the latch arm 32 of one pole unit 10 is released to rotate clockwise as a result of the tripping in that pole, one of the fingers 51 engaging that latch arm 32 is pushed downward thereby so as to rotate the other finger 52 of each pair of extensions 51 counterclockwise, which in turn rotates the trip lever 36 of the other pole unit 10 clockwise, thus effecting the simultaneous tripping of the other pole unit 10. It is to be noted at this point that the adjacent pole units 10 are interlocked with the pin 26 of the operator lever 24 and the interlocking rod 50 for mechanical coupling between the pole units 10 by means of the manual contact operating mechanism in addition to the trip mechanism.

Also mounted within each pole unit 10 is an polarized electromagnet 60 with an armature 61 which is linked by a point 62 to the operator lever 24 for actuating the movable contact arm 21 through the manual contact operating mechanism between its ON and OFF positions. The electromagnet 60 is of bistable type comprising an excitation coil 63, a pair of inner yokes 64 and a pair of outer yokes 65, and a pair of permanent magnets 66 each interposed between the inner yoke 64 and outer yoke 65. Formed on the armature 61 is a pair of pole plates 67 and 68, one being positioned between the upper pole ends of the inner and outer yokes 64 and 65, and the other between the lower pole ends thereof. The excitation coil 63 is inserted in series with the output section 95 of the electric timer 90 between the line terminals 14 of the adjacent pole units 10 so as to be energized by the common utility power to the load under the control of the electric timer 90. Because of the bistable electromagnet operation, the armature 61 holds the manual contact operating mechanism 20 in both of the ON and OFF positions with the pole plates 67 and 68 being attracted to the upper and lower pole ends by the action of the permanent magnets 66. It is to be noted in this connection that the manual contact operating mechanism 20 requires no conventional over-center spring therein and therefore requires less operating force for turning the movable contact arm 21, reducing the power requirement to the electromagnet 60 and enabling the miniaturization of the electromagnet 60 and therefore the pole unit 10 incorporating the same.

Figure 8:
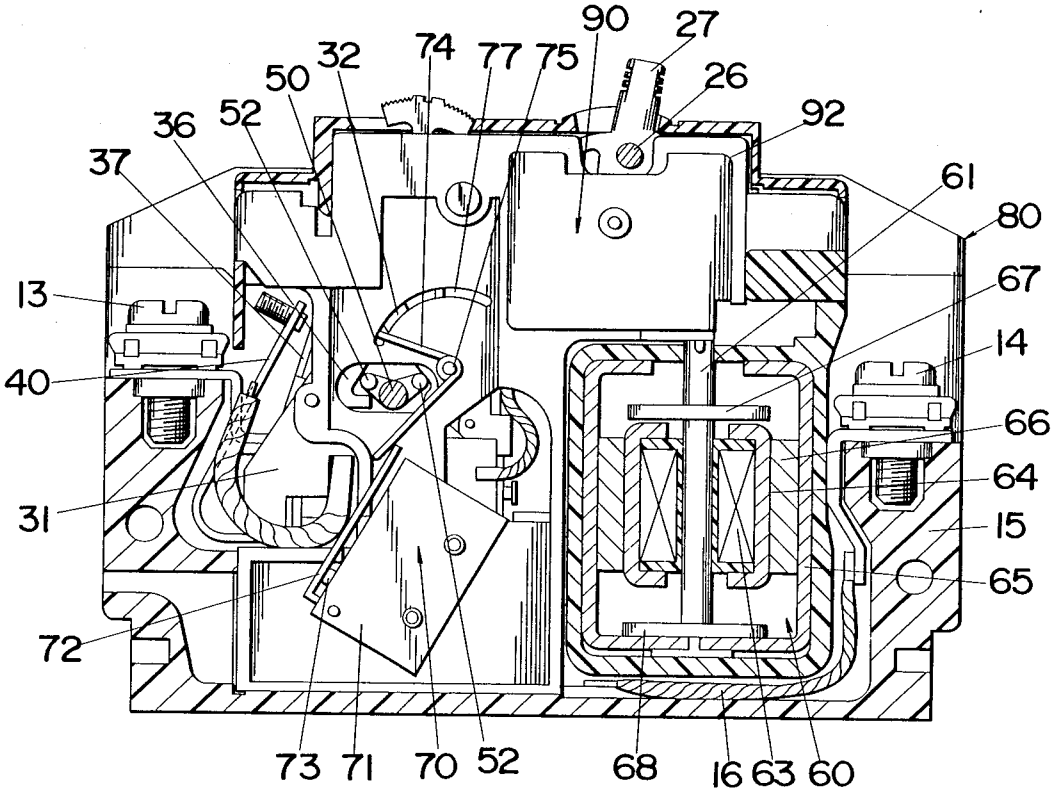
FIG. 8 is an elevational view showing a principal portion of a timer unit with a part of the adjacent pole unit shown in sectional representation.

Referring back to FIG. 3, the excitation coils 63 of the pole units 10 are connected in parallel relation to each other, which parallel combination is inserted in series with electric switch means 70 between the line terminals 14 of the adjacent pole units 10. The switch means 70 is of normally closed configuration and is interlocked with the latch arm 32 of the pole unit 10 such that it is disconnected when the latch arm 32 of any one of the pole units 10 is tripped to open the contacts and is kept disconnected until the latch arm 32 is manually reset, thus inhibiting the automatic reclosing of the contacts by the electromagnet 60 under the control of the timer 90 in the timing cycle subsequent to the timing cycle during which the tripping occurs and permitting the automatic reclosing of the contacts only after the trip mechanism 30 is manually reset. The switch means 70 comprises an miniature snap-action switch 71 with a spring biased actuator 72 pivoted at its end for actuation of a button 73 of the switch 71. As shown in FIG. 8, the snap-action switch 71 is mounted in the timer unit 80 with its actuator 72 in pressing engagement with one end of a joint lever 74 pivotally supported in the timer unit 80 at 75. The other end 76 of the joint lever 74 extends through an arcuate slot 77 into the adjacent pole unit 10 to be engaged with the latch arm 32 such that, when the latch arm 32 rotates clockwise as a result of the tripping operation, the joint lever 74 is urged by the spring force of the actuator 72 to rotate clockwise, leaving the actuator 72 to release the button 73 for opening the switch 71.

Second embodiment <FIGS. 11 through 17>

In the second preferred embodiment of the present invention, there is disclosed a timer controlled multipole circuit breaker which has a unique breaker mechanism particularly advantageous for timer control. The breaker is likewise of two pole configuration and composed of three substantially identically dimensioned units, i.e., a pair of adjacent pole units 110A and 110B and a timer units 180. These units are stacked in side-by-side relation and secured together to present a unitary breaker enclosure. Each of the pole units 110A and 110B includes within a casing 115 a single set of first and second contacts 111 and 112 which are connected to a load terminal 113 and a line terminals 114 on the opposite ends of the casing 115.

Figure 12:
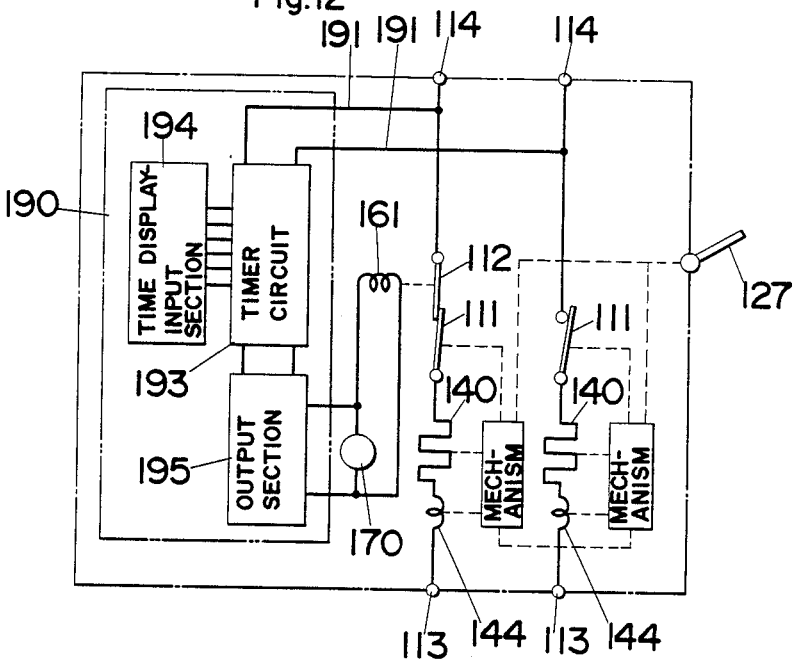
FIG. 12 is a circuit diagram of the breaker of FIG. 11.

The timer unit 180 has within a casing 181 an electric timer 190 which is identical in function to that described in the first embodiment and is likewise connected through lines 191 to the line terminals 114 of the adjacent pole units 110A and 110B, as shown in FIG. 12, such wiring between the electric timer 191 and the line terminals 114 being arranged not to appear on the exterior of the breaker enclosure. In FIG. 12, the electric timer 190 is shown to be functionally composed of a timer circuit 193, time display-input section 194 and output section 195. Formed on top of the timer unit 180 are like selector 182 for selection between the different timing cycles prepared, digital display 184 for indication of the current time, and time variable input buttons 185 for inputting the current time to the timer circuit 193.

Figure 13:
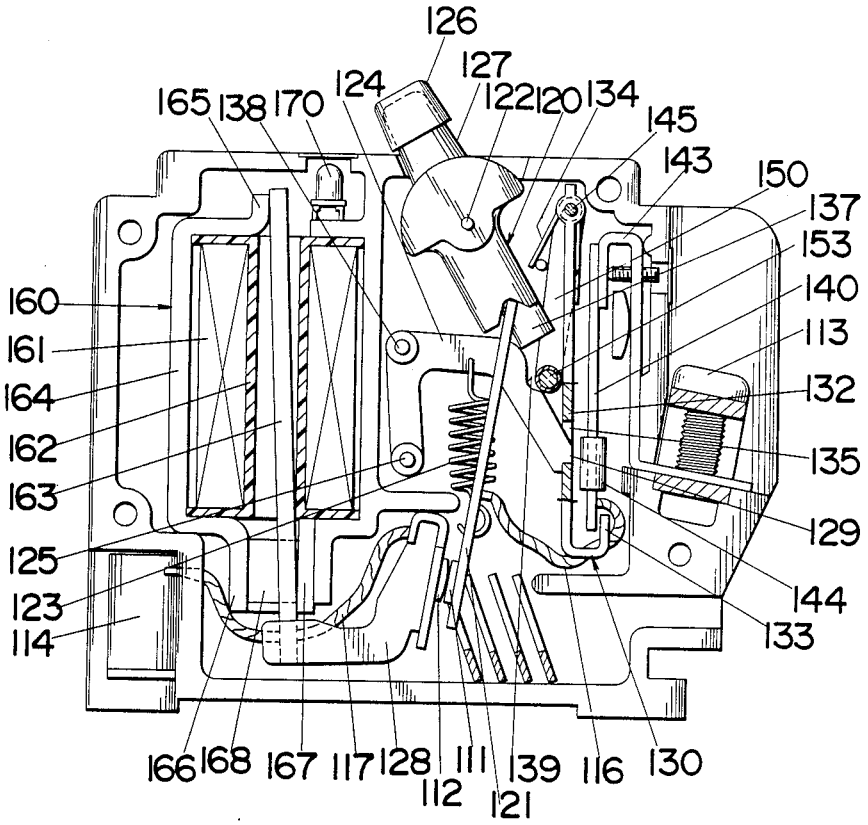
FIG. 13 is a sectional view of one pole unit of the breaker in its ON position.
Figure 14:
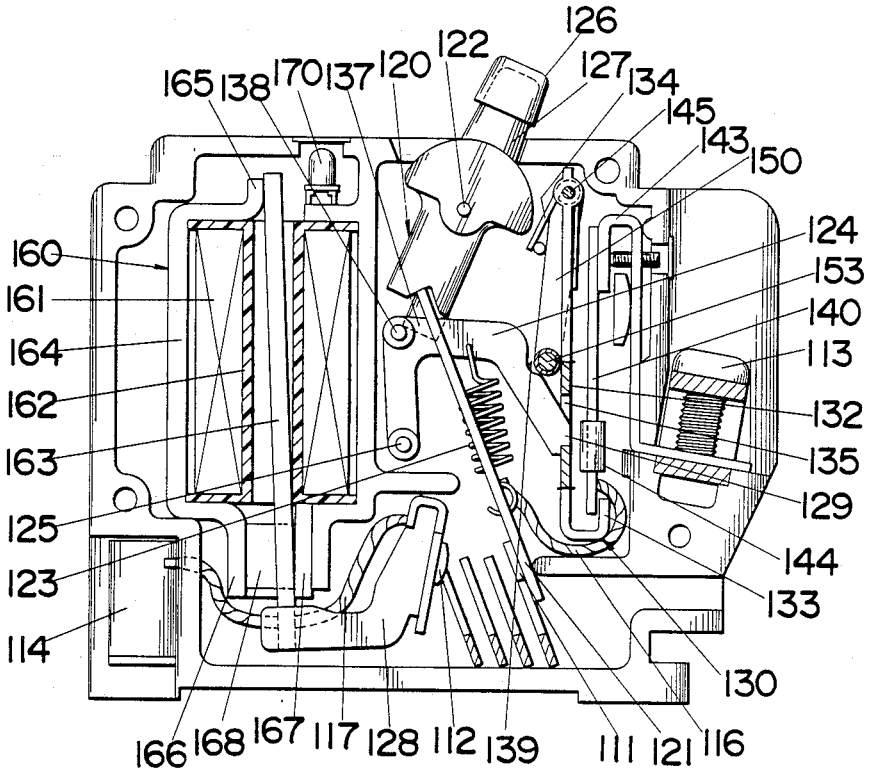
FIG. 14 is a sectional view of the pole unit of the breaker in its OFF position.

Provided in each of the pole units 110A, 110B is a manual contact operating mechanism 120 of conventional arrangement comprising a manual handle 127 pivoted at 122, a movable contact arm 121 carrying the first contact 111, and an over-center action spring 123 which effects the closing and opening of the contacts in quick-make and quick-break fashion. The first contact 111 is electrically connected through the movable contact arm 121, a braid 116, and bimetallic strip 140 to the load terminal 113, while the second contact 112 is electrically connected through a contact carrier 128 thereof, braid 117 to the line terminal of a female stab type. The movable contact arm 121 has its upper end in pivotal abutment with the lower end of the manual handle 127 to be operatively connected thereto so that it is movable in response to the manipulation of the manual handle 127 between an ON condition where the first contact 111 is in engagement with the second contact 112, as shown in FIG. 13, and an OFF condition where the first contact 111 is away from the second contact 112 for separation of the contacts, as shown in FIG. 14.

The over-center action spring 123 extends between the movable contact arm 121 and a cradle 124 pivotally supported at its end to a cradle pivot 125 in such a way as to have its line of action in directions of biasing the movable contact arm 121 for bringing the first contact 111 into and out of contacting engagement in an over-center manner as the handle 127 is manipulated to its counterclockwise-most ON position and clockwise-most OFF position, respectively. The manual contact operating mechanisms 120 of the adjacent pole units 110A and 110B are interlocked by means of a handle cap 126 straddling over the handles 127 for simultaneous actuation of the manual contact operating mechanisms of the adjacent pole units 110A and 110B.

Figure 15:
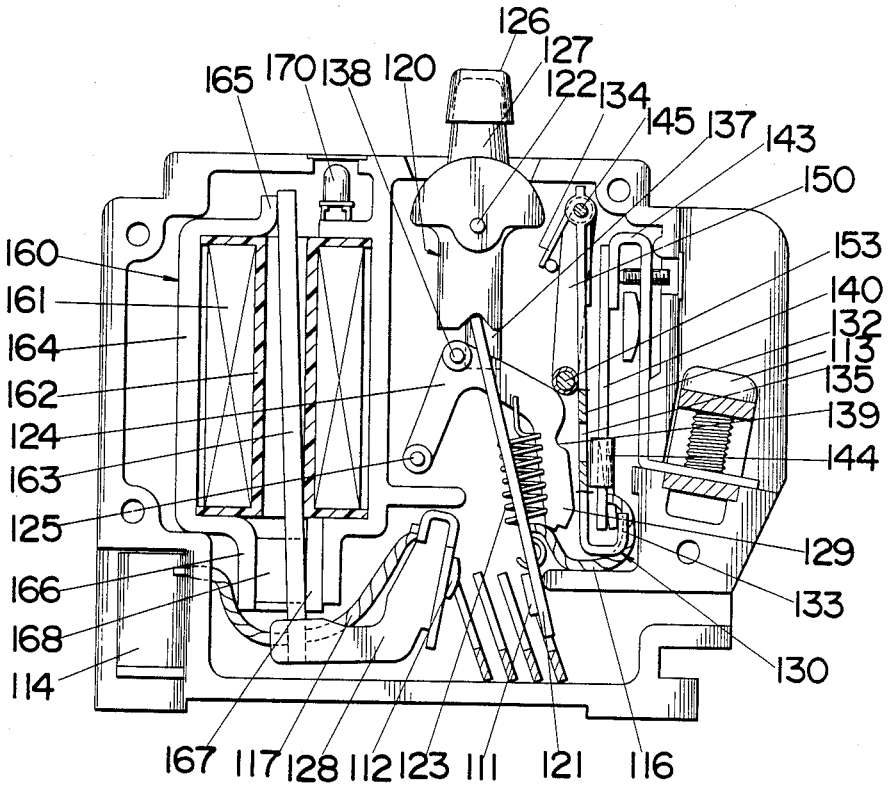
FIG. 15 is a sectional view of the pole unit of the breaker in its tripped position as a result of fault current condition.

Also mounted in each of the pole units 110A and 110B is a trip mechanism 130 which is operatively connected through the cradle 124 to the above manually operable switching mechanism 120 in order to separate the contacts 111 and 112 upon the occurrence of fault current conditions. The trip mechanism 130 is also of conventional arrangement which includes a latch arm 132 and the bimetallic strip 140 with a current sensing magnet 144 fixed at a portion thereof. The bimetallic strip 140 is fixed at its upper end to one end of a strap 143 leading to the load terminal 113. The latch arm 132 extends in generally parallel relation to the bimetallic strip 140 and is pivoted at its upper end to a pin 145 and is urged by a torsion spring 134 in a clockwise direction as viewed in the figures. The lower end portion of the latch arm 132 is bent upwardly into a U-shaped hook 133 engageable with the lower end of the bimetallic strip 140. Formed in the latch arm 132 at intermediate portion thereof is a latch hole 135 with which a latch end 129 of the cradle 124 engages to retain the cradle 124 in an untripped position against the biasing force of the over-center action spring 123. Upon occurrence of an overload current condition, the bimetallic strip 140 is resistively heated to deflect the lower end thereof to the right for engagement with the hook 133, thereby causing the latch arm 132 to move in the counterclockwise direction so as to unlatch the cradle 124, with the result of which the cradle 124 is free to rotate under the urgence of the over-center action spring 123 into a tripped position as shown in FIG. 15 so as to rapidly move the movable contact arm 121 away from the second contact 112. The magnet 144 fixed to the bimetallic strip 140 is a U-shaped member which surrounds the three sides thereof with its legs in facing relation to the latch arm 132 such that, when short-circuit current flows through the breaker circuit or the bimetallic strip 140, it is magnetized thereby to attract the latch arm 132, unlatching the cradle 124 in the like manner into the tripped position for separation of the contacts, at which occurrence the manual handle 127 is moved to the intermediate position between the ON and OFF indicating position, as shown in FIG. 15. Reset of the cradle 124 is made simply by pivoting the handle 127 to its clockwise-most or OFF position, during which operation a reset lever 137 at the lower extremity of the handle 127 pushes a pin 138 on the intermediate portion of the cradle 124 to thereby move the cradle 124 in the counterclockwise direction as the handle 127 rotates to move the movable contact arm 121 into the OFF condition, allowing the latch end 129 to slide upwardly along the latch arm 132 into latching engagement with the latch hole 135 thereof. In this manner the cradle 124 or the manually operable switching mechanism 120 is restored to its untripped position, as shown in FIG. 14.

Figure 17:
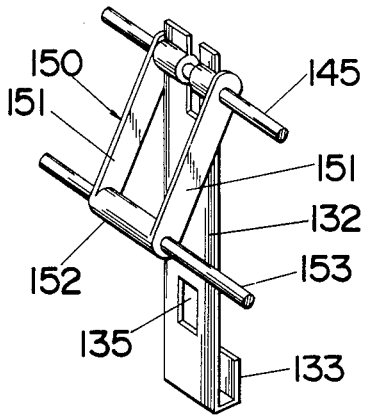
FIG. 17 is a perspective view of a trip arm and a swing member for interlocking the trip mechanism between the adjacent pole units of the breaker.

Provided in association with the trip mechanism 130 of each pole unit 110A, 110B is a swing member 150 of U-shaped configuration with a pair of legs 151 connected at the lower ends by a pipe 152, as best shown in FIG. 17. The swing member 150 is pivoted at the upper end of the legs 151 to the common pivot pin 145 to which the latch arm 132 is pivoted in such a manner that the pipe 152 rests on the intermediate portion of the latch arm 132 in engageable relation with a notched portion 139 of the cradle 124. An interlocking shaft 153 extends through the pipes 152 of the swing members 150 in the adjacent pole units 110A and 110B so that the swing members 150 are interlocked for synchronous operation. When anyone of the pole units 110A and 110B sees the fault current condition to interrupt the contacts as tripping the cradle 124 of that pole unit, the cradle 124 pushes the swing members 150 interlocked with each other to unlatch the latch arm 132 of the other pole unit, whereby effecting the tripping of the other pole unit and assuring simultaneous contact interruption of the pole units 110A and 110B upon occurrence of a fault current condition in any one of the poles.

In the pole unit 110A stacked adjacent to the timer unit 180, the contact carrier 128 of the second contact 112 is movable between an operative position where the second contact 112 is engageable with the first contact 111 and an inoperative or disable position where it is inhibited from engaging with the first contact 11 even when the movable contact arm 121 is held in its ON position. While on the other hand, the other pole unit 110B has a fixed contact carrier (not shown) for only permitting manual contact operation and the tripping operation. Also mounted in the pole unit 110A featuring the movable second contact 112 is a timer controllable contact driver 160 which is operatively connected to the contact carrier 128 of the second contact 112 for movement thereof between the operative and inoperative positions under the control of the electric timer 190.

The driver 160 is prepared in the form of a polarized electromagnet of monostable type comprising an excitation coil 161 wound around a bobbin 162, an armature 163 extending axially through the bobbin 162, a yoke 164 mounted on one side of the bobbin 162 with flanges 165 and 166 at its both ends extending axially outwardly from the axial ends of the bobbin 162, the flange 165 on the upper end of the bobbin 162 defining a first pole end to which the one end of the armature 163 is pivotally supported and the other flange 166 on the lower end of the bobbin 162 defining a second pole end which is spaced laterally from a pole piece 167 projecting on the lower end of the bobbin 162. The excitation coil 161 is connected through the output section 195 of the electric timer 190 to the line terminals 114 of the adjacent pole units 110A and 110B so as to be energized by the common utility power on the line terminals 14. A permanent magnet 168 is disposed between the second pole end 166 and the pole piece 167 for magnetizing them in opposite polarity and at the same time interconnecting them in such a manner as to leave therebetween a gap into which the free end of the armature 163 extends. It is this armature 163 that is connected at its free end to the contact carrier 128 of the second contact 112 for movement thereof upon energization and deenergization of the electromagnet 160.

Figure 16:
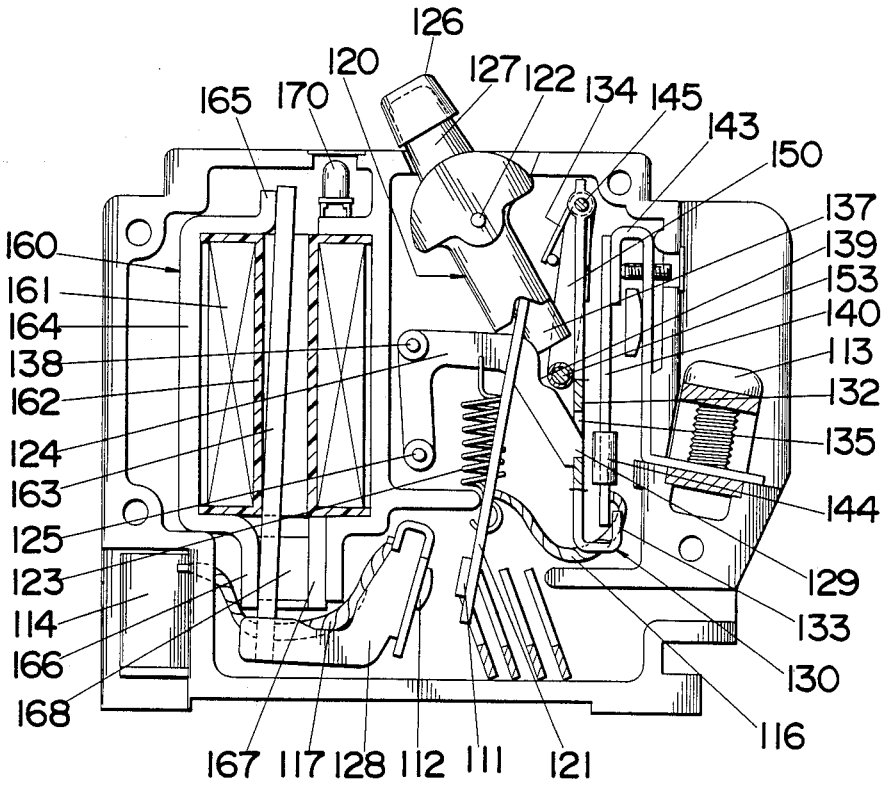
FIG. 16 is a sectional view of the pole unit of the breaker with its contacts opened by an incorporated timer.

The armature 163 is stable at the position of FIG. 13 where it has its free end attracted by the effect of the permanent magnet 168 to the pole piece 167 so as to complete the magnetic circuit of the magnetic flux emanating from permanent magnet 168 through the pole piece 167, armature 163, first pole end 165, yoke 164, second pole end 166 and returning to permanent magnet 168. In the absence of the energization, the armature 163 is retained at this stable position by the permanent magnet 168, permitting the contacts to be selectively closed and opened by the operation of said manual contact operating mechanism 120. When the electromagnet 160 is energized under the control of the electric timer 190, the free end of the armature 163 becomes magnetized in the same polarity as the pole piece 167 but in the opposite polarity to the second pole end 166 so as to be attracted thereto, thus moving the second contact 112 away from the first contact 111 into its inoperative position, as shown in FIG. 16. The armature 163 is retained at this position while the electromagnet 160 is continuously energized and returns back to its stable position upon deenergization thereof, allowing the second contact 112 to resume the operative position. An indicator lamp 170, which is viewed through the upper wall of the timer unit 180, is inserted in parallel with the excitation coil 161 so as to be turned on when the latter is energized for providing the visual indication of the contact being closed under the control of the electric timer 190.

Since the electromagnet 160 is connected to the movable second contact 112 and not to the manual contact operating mechanism 120, it never act to reset the trip mechanism 130 so that the contacts can be inhibited from automatically reclosing by the timer control in the timing cycle subsequent to the timing cycle during which the tripping occurs. In this respect, the present embodiment featuring the movable second contact 112 to be driven by the electromagnet 160 under the control of the electric timer 190 is advantageous for eliminating the undesirable automatic reclosing of the contacts without the necessity of adding the switch means or the like inhibition means as employed in the first embodiment.

Although the above embodiments disclose only the particular breaker structures in which each pole unit is provided with the manual contact operating and tripping mechanisms, the present invention should not be understood to be limited to these particular breaker mechanisms and can be well applied for any other breaker mechanism including that disclosed in U.S. Pat. No. 3,849,751 in which a common manual contact operating and tripping mechanisms are responsible for opening and closing the contacts of all pole units.

What is claimed is:

1. A timer controlled multipole circuit breaker provided with individual current paths for more than one pole which comprises:

a pair of breaker contacts in each pole which are connected to load and line terminals respectively provided in the current path of each pole;

manual contact operating means for simultaneously closing and opening the breaker contacts of all poles;

fault current sensing means in each pole;

trip means for tripping manual contact operating means to open the breaker contacts upon occurrence of a fault current condition in any one of all poles;

timer controllable contact driver means for closing the breaker contacts and for opening the breaker contacts independently of the trip means; and electric timer means for controlling said contact driver means to close the breaker contacts at a first predetermined time and reopen the contacts at a second predetermined time; said electrical timer means having its input ends connected across the line terminals of a pair of the adjacent poles so as to be energized by utility power on the line terminals of the breaker.

2. A timer controlled multipole circuit breaker as set forth in claim 1, wherein said contact driver means comprises an electromagnet with an armature which is energized from the utility power through the line terminals of the adjacent poles for closing and opening the breaker contacts under the control of said electric timer means.

3. A timer controlled multipole circuit breaker as set forth in claim 1, wherein the closing of the breaker contacts from the electric timer means is inhibited so long as the manual contact operating means is tripped to its OFF position of opening the contacts.

4. A timer controlled multipole circuit breaker as set forth in claim 3, wherein said contact drive means is operatively linked to the manual contact operating means for closing and opening the contacts, and said contact drive means is operatively connected to said trip means such that it is inhibited from actuating the manual contact operating means so long as the contact operating means is tripped to its OFF position.

5. A timer controlled multipole circuit breaker as set forth in claim 3, wherein said contact operating means includes a movable contact arm in each pole which carries one of the breaker contacts engageable with the other breaker contact, the other breaker contact of at least one pole being movable between an operative position where it is engageable with the contact on the movable arm and an inoperative position where it is prevented from engaging the contact on the movable arm irrespective of the positions of the manual contact operating means, and said other breaker contact being actuated by the contact driver means to move between the operative and inoperative positions whereby the contact closing by the contact driver means is inhibited so long as the manual contact operating means is tripped to its OFF position.

6. A timer controlled multipole circuit breaker as set forth in claim 1, further including a breaker enclosure and wherein said electric timer means includes a timer circuit programmed to respectively close and open said breaker contacts in accordance with two different timing cycles and a time display on the exterior of said breaker enclosure.

7. A timer controlled multipole circuit breaker as set forth in claim 1, further including a breaker enclosure and wherein said electric timer means includes a time variable input section having manually actuated means accessible outwardly of said breaker enclosure and shield means which cover said manually actuated means of said time variable input section and the load and line terminals of each pole.

8. A timer controlled multipole circuit breaker as set forth in claim 1, wherein said electric timer means includes a timer circuit programmed to respectively close and open said breaker contacts in accordance with different timing cycles and a selector knob movable between first and second positions each corresponding to one of said different timing cycles.

9. A timer controlled multipole circuit breaker provided with individual current paths for more than one pole which comprises:

a pair of breaker contacts in each pole which are connected to load and line terminals respectively provided in the current path of each pole;

manual contact operative means for simultaneously closing and opening the breaker contacts of all poles;

fault current sensing means in each pole;

trip means for tripping manual contact operating means to open the breaker contacts upon occurence of a fault current condition in any one of all poles;

a polarized electrogmagnet with an excitation coil and an armature which is linked to the manual contact operating means to actuate the same for closing and opening the breaker contacts upon selective energization of said excitation coil, said electromagnet being of bistable operation so as to stably hold the manual contact operating means in both the contact closing and contact opening positions;

electric timer means for controlling said electromagnet so as to close the breaker contacts at a first predetermined time and open the contacts at a second predetermined time, said electric timer means having its input ends connected across the line terminals of a pair of the adjacent poles so as to be energized by utility power on the line terminals of the breaker; and normally closed electric switch means connected in series with the excitation coil of the electromagnet between the input terminals of the adjacent poles providing the electric power to said timer means, said electric switch means being operatively connected to the trip means such that it is kept disconnected so long as manual contact operating means is tripped to its OFF position of opening the contacts.

10. A timer controlled multipole circuit breaker as set forth in claim 9, wherein said electromagnet is provided in each pole with the excitation coils of the electromagnet in all poles being connected in parallel relation to each other, which parallel combination is inserted in series with said electric switch means between the input terminals of the adjacent poles providing the electric power to said electric timer means.

11. A timer controlled multipole circuit breaker as set forth in claim 10, further including a breaker enclosure and wherein said electric timer means includes a timer circuit programmed to respectively close and open said breaker contacts in accordance with two different timing cycles and a time display on the exterior of said breaker enclosure.

12. A timer controlled multipole circuit breaker as set forth in claim 9, further including a breaker enclosure and wherein said electric timer means includes a time variable input section having manually actuated means accessible outwardly of said breaker enclosure and shield means which cover said manually actuated means of said time variable input section and the load and line terminals of each pole.

13. A timer controlled multipole circuit breaker as set forth in claim 9, wherein said electric timer means includes a timer circuit programmed to respectively close and open said breaker contacts in accordance with different timing cycles and a selector knob movable between first and second positions each corresponding to one of said different timing cycles.

14. A timer controlled multipole circuit breaker provided with individual current paths for more than one pole which comprises:

a single set of breaker contacts in each pole which are connected to load and line terminals respectively provided in the current path of each pole;

manual contact operating means for simultaneously closing and opening the breaker contacts of all poles, said contact operating means including a movable contact arm in each pole which carries one of the breaker contacts engageable with the other breaker contact; said other breaker contact of at least one pole being movable between an operative position where it is engageable with the contact on the movable arm and an inoperative position where it is prevented from engaging the contact on movable arm irrespective of the positions of the movable contact arm;

fault current sensing means in each pole;

trip means for tripping the movable contact arm to open the breaker contacts upon occurrence of a fault current condition in any one of all poles;

timer controllable contact driver means operatively connected to said other movable breaker contact for movement thereof between the operative and inoperative positions, whereby inhibiting the other movable contact from engaging the contact on the movable arm irrespective of the positions of the movable contact arm when the other breaker contact is moved into the inoperative position;

electric timer means for controlling said contact drive means to move the other breaker contact into its operative position at a first predetermined time and move it back into its inoperative position at a second predetermined time; and said electric timer means having its input ends connected across the line terminals of a pair of the adjacent poles so as to be energized by utility power on the line terminals of the breaker.

15. A timer controlled multipole circuit breaker as set forth in claim 14, wherein said contact drive means comprising a polarized electromagnet with an excitation coil and an armature which is energized from the utility power through the line terminals of the adjacent poles, said armature being linked to the other breaker contact for actuating the same from its operative position to inoperative position upon selective energization of said excitation coil, and said electromagnet being of monostable operation so as to stably hold the other contact at its operative position in the absence of the energization of the excitation coil.

16. A timer controlled multipole circuit breaker as set forth in claim 14, further including a breaker enclosure and wherein said electric timer means includes a timer circuit programmed to respectively close and open said breaker contacts in accordance with two different timing cycles and a time display on the exterior of said breaker enclosure.

17. A timer controlled multipole circuit breaker as set forth in claim 14, further including a breaker enclosure and wherein said electric timer means includes a time variable input section having manually actuated means accessible outwardly of said breaker enclosure and shield means which cover said manually actuated means of said time variable input section and the load and line terminals of each pole.

18. A timer controlled multipole circuit breaker as set forth in claim 17, wherein said electric timer means includes a timer circuit programmed to respectively close and open said breaker contacts in accordance with different timing cycles and a selector knob movable between first and second positions each corresponding to one of said different timing cycles.

* * * * *